US007984825B2

(12) United States Patent
Ophardt et al.

(10) Patent No.: US 7,984,825 B2
(45) Date of Patent: Jul. 26, 2011

(54) OPTICALLY KEYED DISPENSER

(75) Inventors: Heiner Ophardt, Vineland (CA); Andrew Jones, Smithville (CA)

(73) Assignee: Gotohti.com Inc., Beamsville, Ontario (CA)

( * ) Notice: Subject to any disclaimer, the term of this patent is extended or adjusted under 35 U.S.C. 154(b) by 1029 days.

(21) Appl. No.: 11/881,753

(22) Filed: Jul. 30, 2007

(65) Prior Publication Data

US 2008/0308574 A1 Dec. 18, 2008

(30) Foreign Application Priority Data

Jun. 18, 2007 (CA) ..... 2592186

(51) Int. Cl.
*G01F 11/00* (2006.01)

(52) U.S. Cl. ..... 222/1; 222/52; 222/63; 222/181.1; 222/181.3; 222/183; 222/325; 250/221; 250/372

(58) Field of Classification Search ..... 222/1, 52, 222/63, 181.1, 183, 181.3, 325, 113, 333, 222/327, 372, 383.1; 250/221, 372
See application file for complete search history.

(56) References Cited

U.S. PATENT DOCUMENTS 4,711,368 A 12/1987 Simons
4,722,372 A * 2/1988 Hoffman et al. ..... 141/98
5,373,970 A 12/1994 Ophardt
5,851,108 A * 12/1998 Clymer et al. ..... 417/44.1
5,979,500 A * 11/1999 Jahrling et al. ..... 137/624.12
6,206,238 B1 3/2001 Ophardt
6,607,103 B2 * 8/2003 Gerenraich et al. ..... 222/183
7,247,140 B2 * 7/2007 Ophardt ..... 600/437
7,451,894 B2 * 11/2008 Ophardt ..... 222/52
7,621,426 B2 * 11/2009 Reynolds et al. ..... 222/325
2005/0127090 A1 6/2005 Sayers et al.
2006/0124662 A1 6/2006 Reynolds et al.

FOREIGN PATENT DOCUMENTS

DE 20 2004 013 101 U1 12/2004

OTHER PUBLICATIONS

English Translation of DE 20 2004 013 101.

* cited by examiner

*Primary Examiner* — Frederick C. Nicolas
(74) *Attorney, Agent, or Firm* — Riches, McKenzie & Herbert LLP

(57) ABSTRACT

A method of controlling operation of a mechanism, preferably a dispenser, having a removable component comprises measuring electromagnetic radiation passing through a wave guide carrying at least in part on the removable component and permitting operation of the mechanism only when the measured electromagnetic radiation corresponds with one or more pre-selected parameters. Preferably, the method involves directing emitted electromagnetic radiation with pre-selected input parameters selected from a plurality of input parameters.

19 Claims, 14 Drawing Sheets

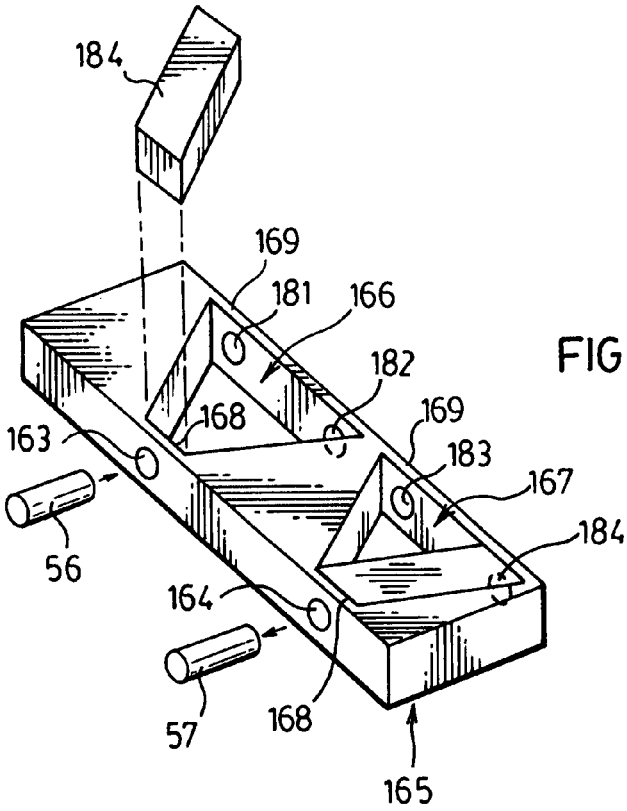
FIG. 15.
FIG. 16.
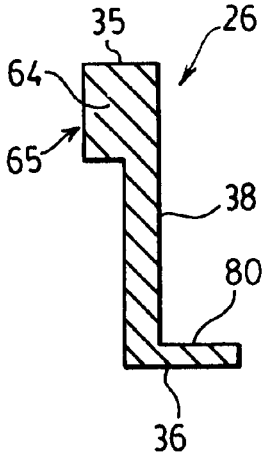
FIG. 17.
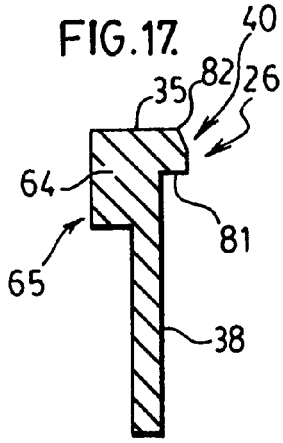
FIG. 18.
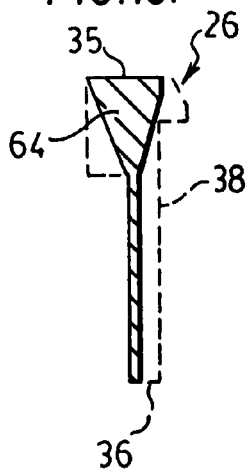

FIG. 19
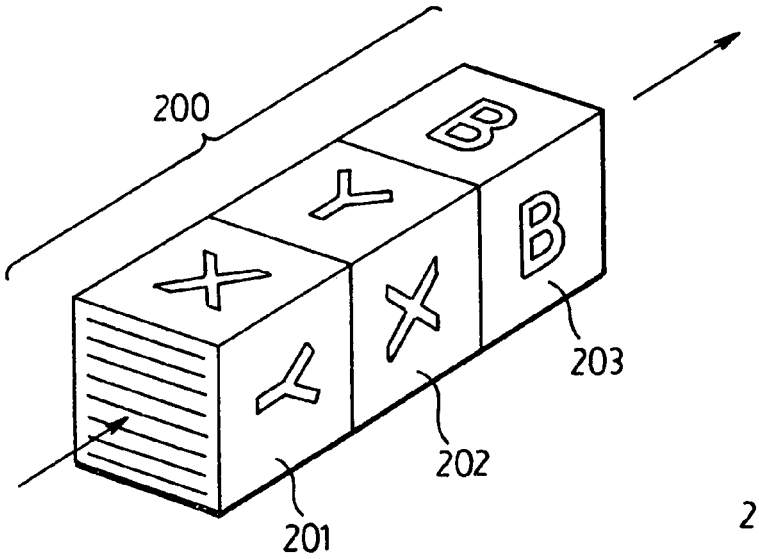
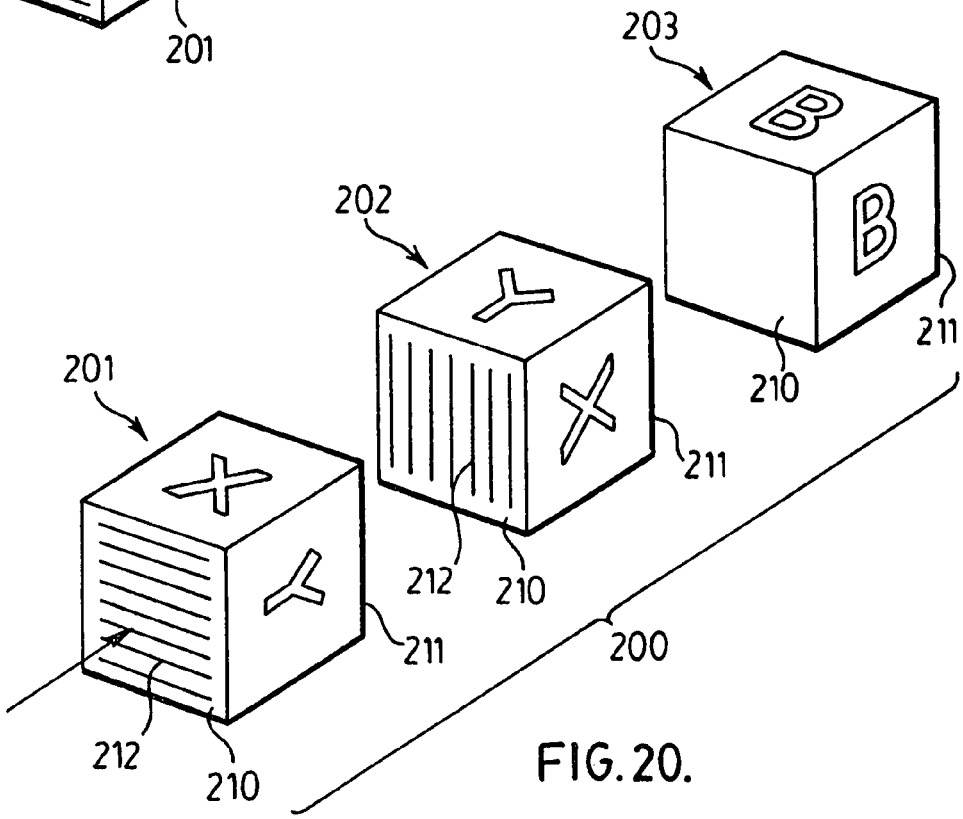
FIG. 20.

OPTICALLY KEYED DISPENSER

SCOPE OF THE INVENTION

This invention relates to an optical key system for determining conditions of compatibility by sensing electromagnetic waves exiting from a wave guide and, more particularly, to dispensing mechanisms whose operation is controlled by an optical key system.

BACKGROUND OF THE INVENTION

Key systems are known in which a particular key is required to be received in a key system as to control an aspect of operation. Many different types of keys are used as, for example, keys to open locks and doors.

In the context of dispensing systems, U.S. Patent Publication US 2006/0124662 to Reynolds et al, the disclosure of which is incorporated herein by reference, teaches an electronically powered key device on a refill container to be removably compatible with a dispenser. The refill container provides a coil terminated by one of a number of capacitors and the container is received in a housing that provides a pair of coils that are in spacial relationship with the installed refill coil. By energizing the housing's coil, the other coil detects the unique electronic signature which, if acceptable, permits the dispensing system to dispense material. The system thus utilizes a near field frequency response to determine whether the refill container is compatible with the dispensing system. A mechanical latching arrangement is provided to retain the container to the housing to ensure correct positioning of the coils.

Such previously known key devices using near field frequency response suffer the disadvantage that they are relatively complex and require a number of metal coils. This is a disadvantage of precluding substantially the entirety of the key device to be manufactured from plastic material and causes difficulties in recycling.

SUMMARY OF THE INVENTION

To at least partially overcome these disadvantages of the previously known devices, the present arrangement provides an optical key system in which two components physically juxtaposed in a latching relation provide a wave guide through which electromagnetic radiation is passed with the electromagnetic radiation transmitted passing through the wave guide being measured for comparison with pre-selected parameters.

An object of the present invention is to provide an optical key system in which compatibility of two mating components is tested by measuring the electromagnetic radiation passed through a wave guide at least partially formed by each of the elements.

Another object is to provide an inexpensive system for determining whether a refill container is compatible with a dispensing system.

Another object is to provide an improved method of controlling the operation of a dispensing mechanism having a removable component.

In one aspect, the present invention provides a method of controlling operation of a mechanism, preferably a dispenser, having a removable component comprising the steps of measuring electromagnetic radiation passing through a wave guide carrying at least in part on the removable component and permitting operation of the mechanism only when the measured electromagnetic radiation corresponds with one or more pre-selected parameters. Preferably, the method involves directing emitted electromagnetic radiation with pre-selected input parameters selected from a plurality of input parameters. The wave guide preferably is provided with pre-selected radiation transmission properties selected from a plurality of electromagnetic radiation transmission properties. The input parameters and radiation transmission properties may be selected from wave length, intensity, duration and placement in time. Preferably, the method is used to control the operation of a dispensing mechanism having as a removable component a replaceable reservoir containing material to be dispensed by operation of the dispenser. Preferably, the wave guide is at least partially carried by the reservoir and is coupled against removal to the reservoir or coupled to the reservoir in a manner that separation of the wave guide and the reservoir results in destruction of the wave guide and/or the reservoir.

A filter may be provided disposed in a transmission path through the wave guide which filter may reduce passage of electromagnetic radiation through the wave guide.

The invention, in another aspect, also provides a dispensing system including a reservoir assembly including a reservoir containing material to be dispensed in an activation unit. The reservoir assembly is removably coupled to the activation unit for replacement by a similar reservoir assembly. An electromagnetic radiation wave guide is provided having an inlet and an outlet and providing a path for transmission of electromagnetic radiation from the inlet to the outlet. An electromagnetic radiation sensor is carried on the activation unit sensing electromagnetic radiation from the wave guide by the outlet. At least part of the wave guide is carried by the reservoir and removable therewith. A control mechanism is provided to permit operation of the dispenser only when the electromagnetic radiation sensed by the sensor appropriately corresponds to a pre-selected electromagnetic radiation profile.

In one aspect, the present invention provides a method of controlling the operation of a mechanism, preferably a dispenser, having a removable component removably coupled thereto comprising the steps of:

measuring electromagnetic radiation passing through a wave guide carried on a removable, replaceable component, and permitting operation of the dispensing mechanism only when the measured electromagnetic radiation complies with one or more pre-selected output parameters.

In another aspect, the present invention provides a dispensing system comprising:

a reservoir assembly including a reservoir containing material to be dispensed and an activation unit, the reservoir assembly removably coupled to the activation unit for replacement by a similar reservoir assembly, an electromagnetic radiation wave guide having an inlet and an outlet and providing a path for transmission of electromagnetic radiation from the inlet to the outlet, an electromagnetic radiation sensor carried by the activation unit sensing electromagnetic radiation from the wave guide via the outlet, at least part of the wave guide carried by the reservoir assembly and removable therewith, a control mechanism to permit operation of the dispenser only when the electromagnetic radiation sensed by the sensor appropriately correlates to a pre-selected electromagnetic radiation profile, preferably with a filter disposed in the path for reducing passage of electromagnetic radiation through the wave guide.

BRIEF DESCRIPTION OF THE DRAWINGS

Further aspects and advantages of the present invention will be come apparent from the following description taken together with the accompanying drawings in which:

FIG. 15 is a schematic pictorial view of a selective optical coupling device in accordance with the present invention;

FIG. 16 is a radial cross-section through one side of the wall of the collar shown in FIG. 7 along section line A-A';

FIG. 17 is a cross-section similar to that shown in FIG. 16, however, along section line B-B' in FIG. 7;

FIG. 18 is a schematic cross-section similar to that shown in FIGS. 16 or 17, however, of a reduced cross-sectional area frangible portion of the wall of the collar;

FIG. 19 is a schematic pictorial representation of a section of a wave guide comprised of three modular wave guide members; and FIG. 20 is a schematic exploded pictorial view of the wave guide members of FIG. 19.

DETAILED DESCRIPTION OF THE DRAWINGS

Figure 1:
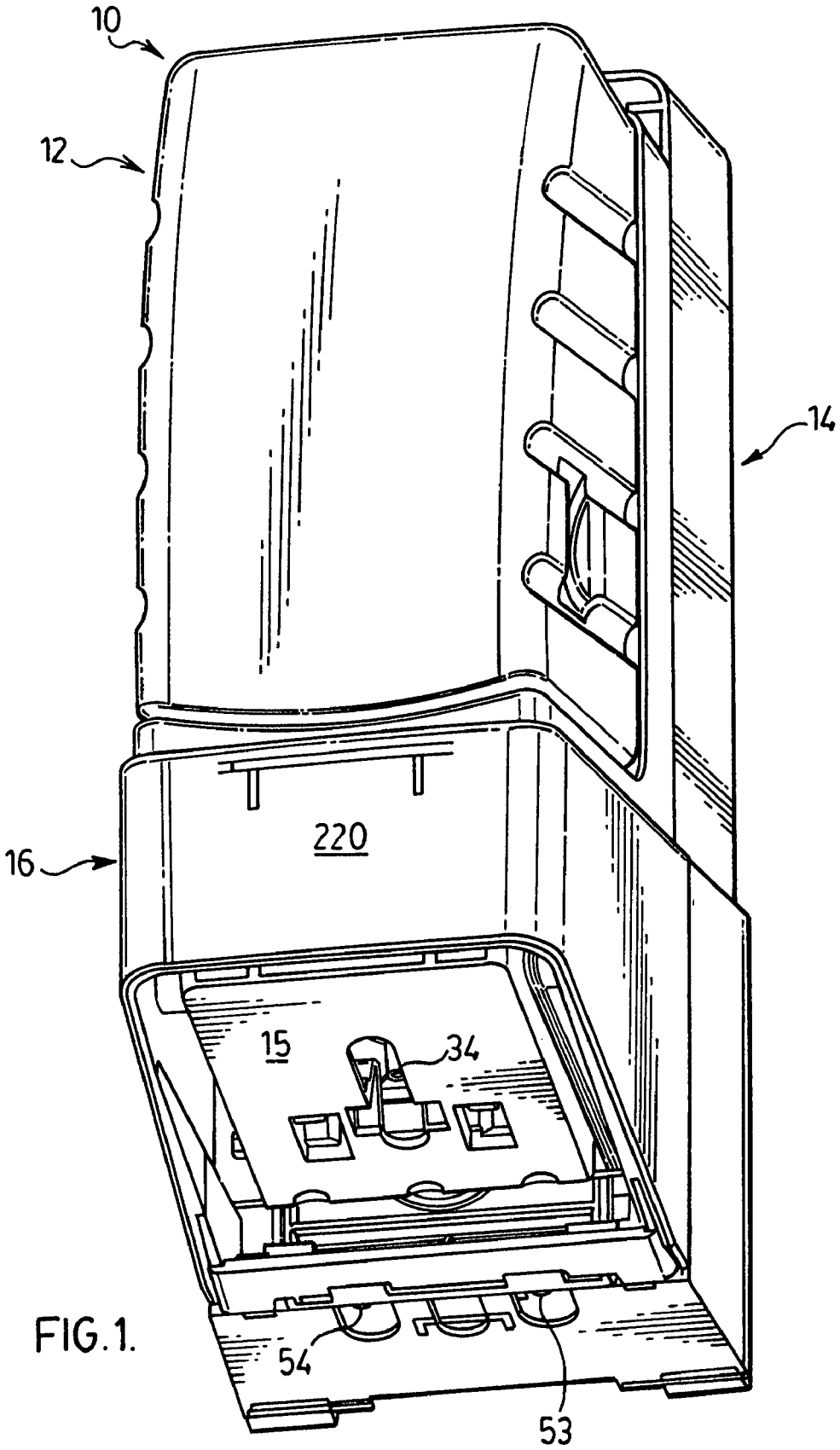
FIG. 1 is a pictorial view of a dispenser assembly in accordance with a first preferred embodiment of the present invention.
Figure 2:
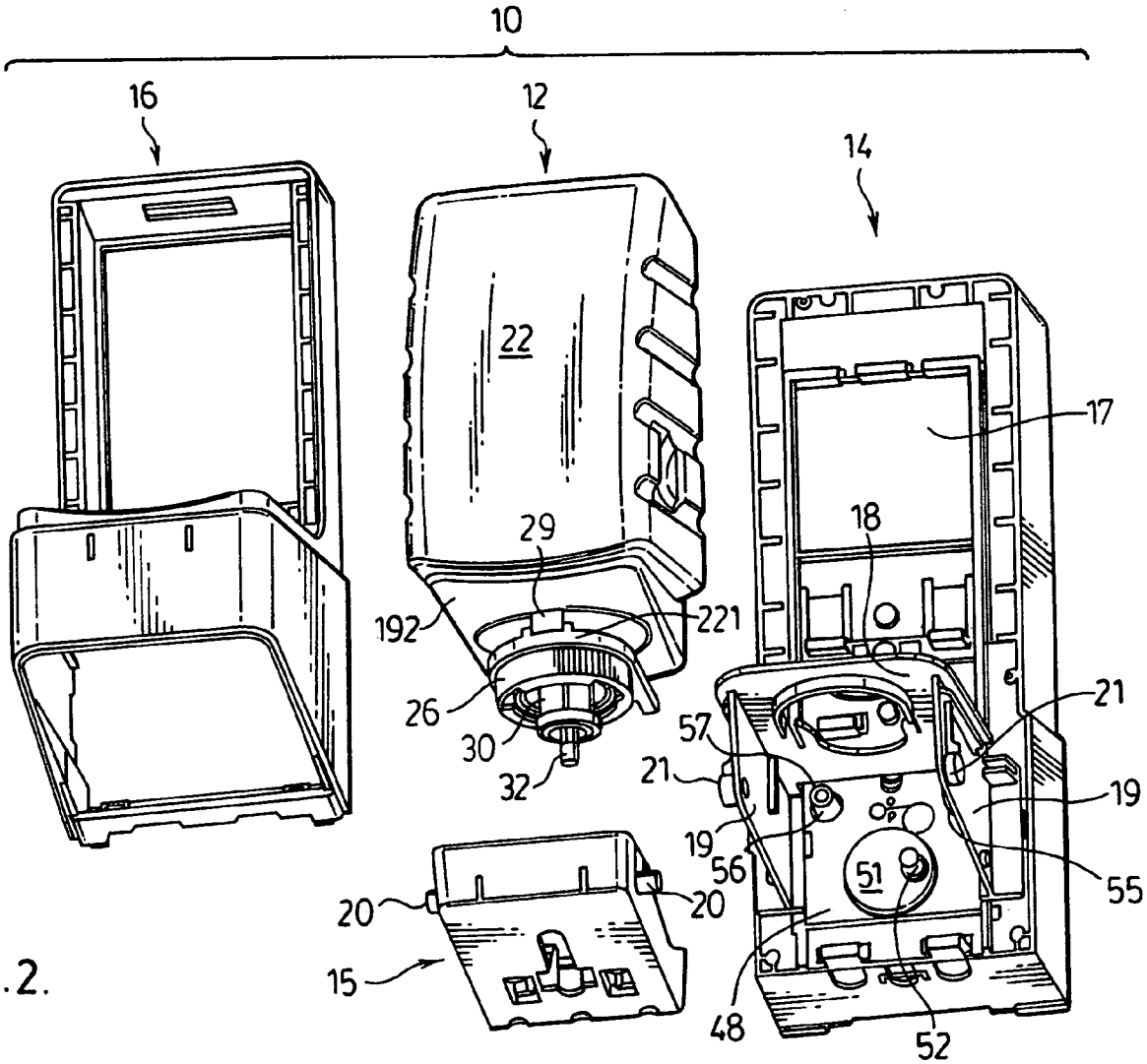
FIG. 2 is a pictorial exploded view of the dispenser assembly shown in FIG. 1.
Figure 3:
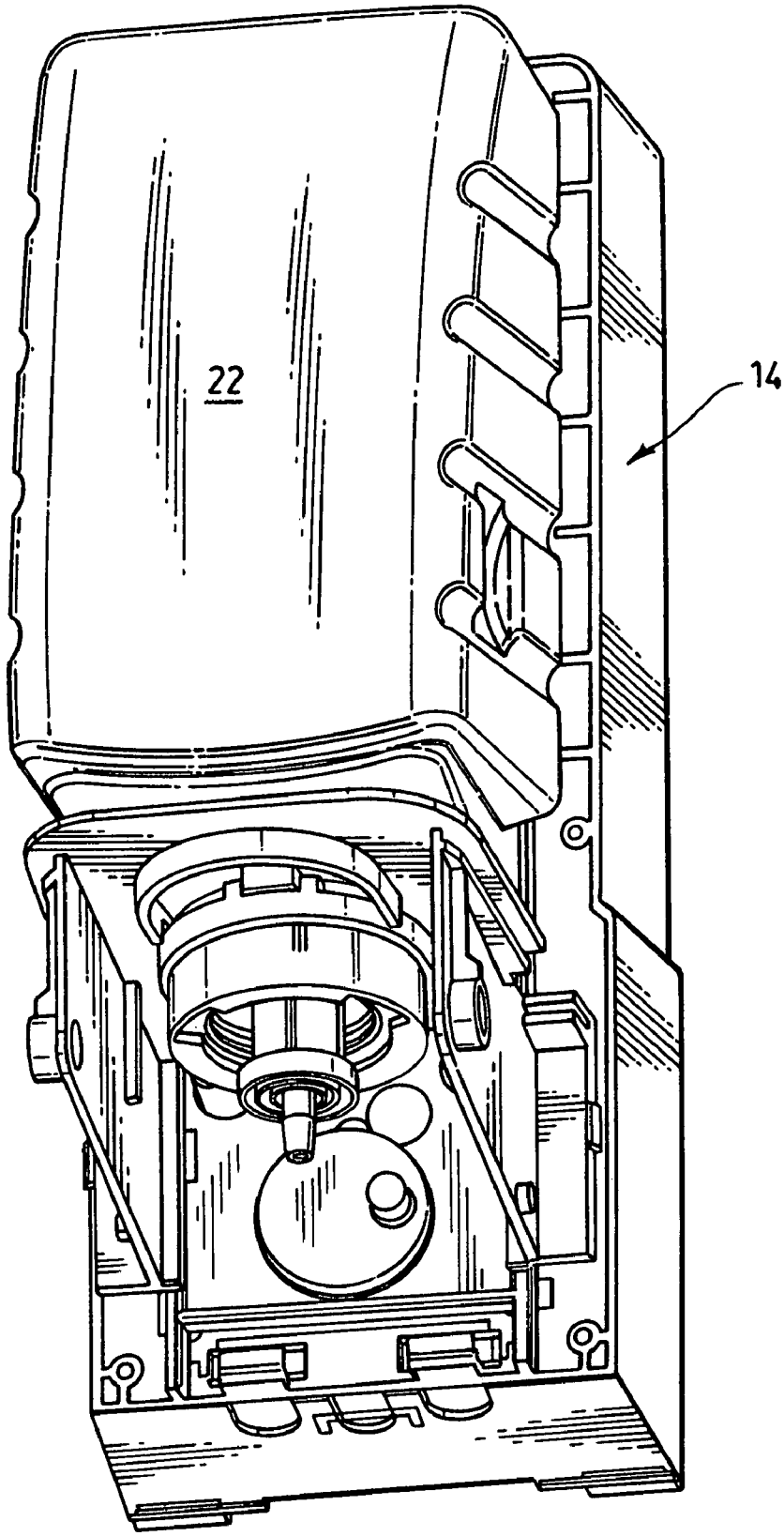
FIG. 3 is a pictorial view showing assembly of the reservoir assembly and backplate assembly shown in FIG. 2.

Reference is made to FIG. 1 which illustrates a dispenser assembly 10 in accordance with a first preferred embodiment of the present invention. The dispenser assembly 10, as best seen in FIG. 2, includes a removable reservoir assembly 12 adapted to be secured to a housing formed by a combination of a backplate assembly 14, a presser member 15 and a shroud 16. The backplate assembly 14 has a generally forwardly directed face plate 17 from which a horizontally disposed support plate 18 extends forwardly supported by two side plates 19. The presser member 15 is pivotally mounted to the backplate assembly 14 between the two side plates 19 with stub axles 20 received in journaling bores 21 in each of the side plates 19. The housing is completed by the shroud 16 being coupled to the backplate assembly 14 to substantially enclose the support plate 18 and the presser member 15. The reservoir assembly 12 is adapted to removably couple to the assembled housing.

Figure 5:
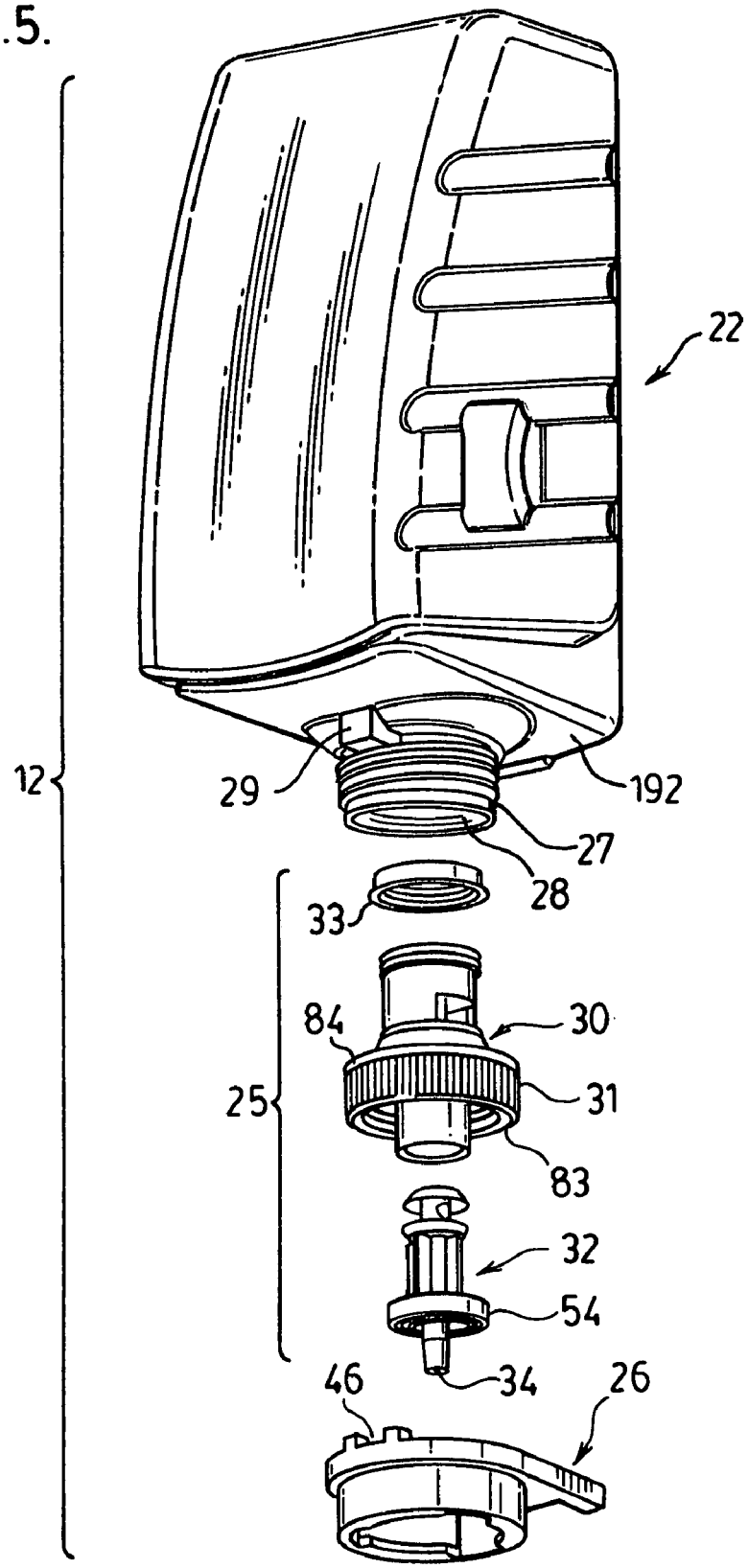
FIG. 5 is an exploded pictorial view of the reservoir assembly shown in FIGS. 2 and 3.

As best seen in FIG. 5, the reservoir assembly 12 comprises a reservoir bottle 22, a pump assembly 25 and a key collar 26. The bottle 22 has a threaded neck 27 about an outlet 28. A locking tab 29 extends forwardly and axially relative to the threaded neck 27 and is of generally rectangular shape in horizontal, axial cross-section having flat parallel side faces and an end face normal thereto. The pump assembly 25 includes a piston chamber forming member 30 having an outer flange 31 which is internally threaded such that the outer flange 31 may be threadably engaged onto the threaded neck 27. The pump assembly 25 further includes a piston 32 and a valve member 33. The piston 32 is reciprocally movable coaxially within a cylindrical chamber formed within the piston chamber forming member 30 so as to dispense fluid from inside the bottle 22 out of the outlet 28 internally through the piston 32 and out a discharge opening 34 of the outer end of the piston 32.

Figure 6:
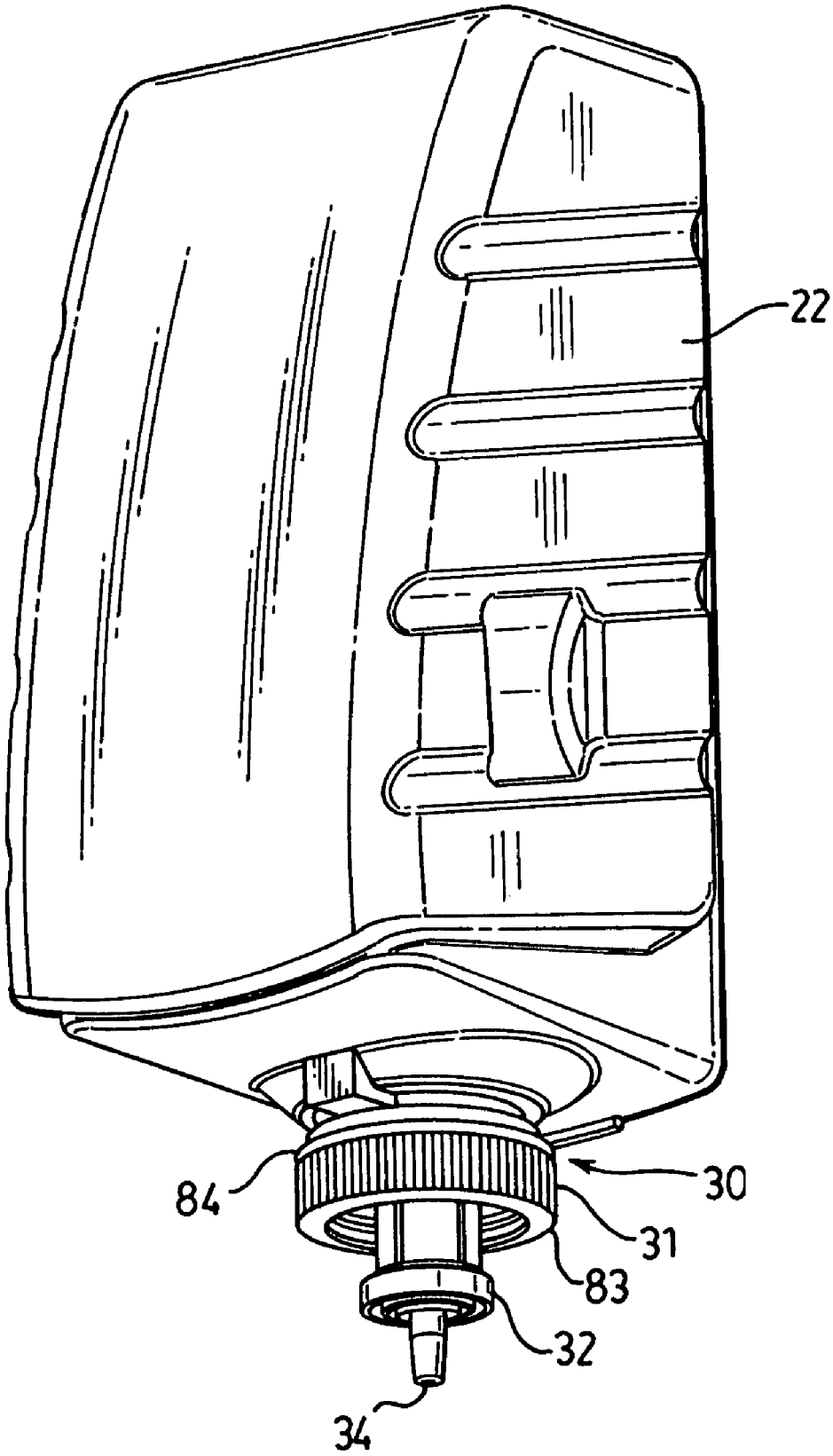
FIG. 6 is a pictorial view showing the assembled bottle, valve member, piston chamber forming member and piston shown in FIG. 5.
Figure 7:
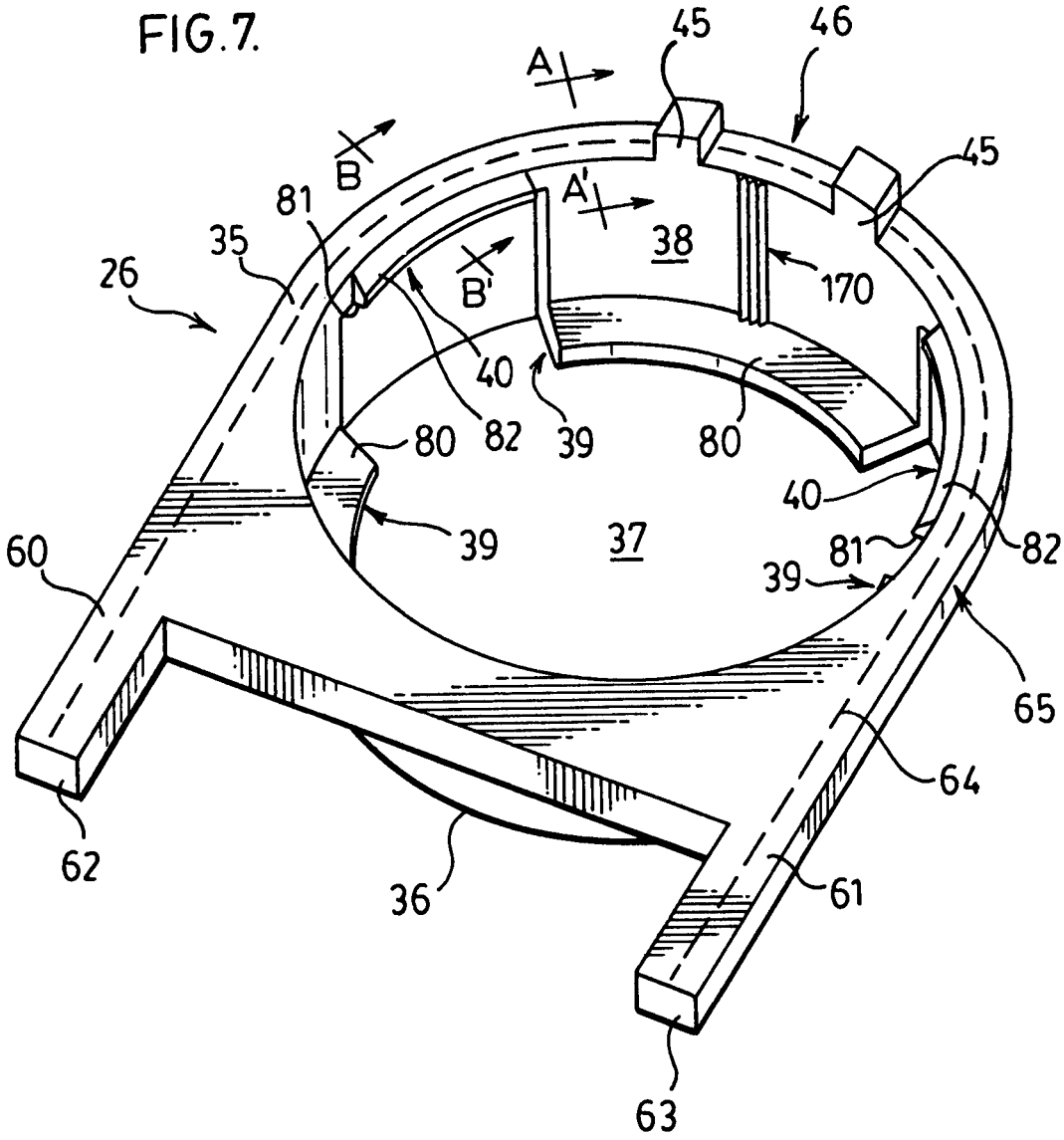
FIG. 7 is a pictorial top rear view of the collar shown in FIG. 5.

The bottle 22 and pump assembly 25 is shown assembled in FIG. 6. To the assembly as shown in FIG. 6, the key collar 26 is applied by sliding the collar 26 axially upwardly such that the collar 26 comes to be engaged in a snap-fit upon the outer flange 31 against removal from the outer flange 31 and with the locking tab 29 engaging in a slotway 46 on the collar 26 so as to prevent rotation of the collar 26 relative to the bottle 22. As seen in FIG. 7, the collar 26 has an axial upper end 35 and an axial lower end 36 with a central, generally cylindrical opening 37 extending therethrough. A generally cylindrical side wall 38 about the opening 37 carries approximate the lower end 36 three radially inwardly extending lower shoulder members 39 presenting stop shoulders 80 directed axially toward the upper end 35. Approximate the upper end 35, the side wall 38 includes three radially inwardly directed upper shoulder members 40. The upper shoulder members 40 have a catch surface 81 directed towards the lower end 36 and a bevelled camming surface 82 directed towards the upper end 35. On sliding of the collar 26 coaxially upwardly onto the outer flange 31, the camming surface 82 of the upper shoulder members 40 engage with an outer lower surface 83 of the outer flange 31 biasing the upper shoulder members 40 radially outwardly to permit the outer flange 31 to move relative the collar 26 axially toward the lower end 36 into the opening 37 of the collar 26. Once an upper end 84 of the outer flange 31 becomes located below the upper shoulder member 40, the upper shoulder member 40 returns to its inherent unbiased position with the catch surface 81 disposed above the upper end 84 of the outer flange 31 radially inwardly therefrom thus locking the outer flange 31 between the stop shoulders 80 of the lower shoulder member 39 and the catch surface 81 of the upper shoulder member 40.

The collar 26 carries on its upper end 35 a pair of upwardly extending lock tabs 45 providing a slotway 46 therebetween. The slotway 46 is sized to closely receive the locking tab 29 of the bottle 22 therebetween. When coupling the collar 26 onto the assembled bottle 22 and pump assembly 25, the slotway 46 is circumferentially aligned with the locking tab 29 on the bottle 22 such that the reservoir assembly 12 when fully assembled as shown in FIG. 2 has the locking tab 29 on the bottle 22 received within the slotway 46 preventing relative rotation of the collar 26 and bottle 12. In the reservoir assembly 12 as shown in FIG. 2, the piston chamber forming member 30 and the collar 26 are secured to the bottle 22 against removal. That is, the key collar 26 and piston chamber forming member 30 are preferably secured on the bottle 22 substantially against removal other than by significant breaking or deformation of the bottle 22 or key collar 26.

The extent to which removal or attempted removal of the collar 26 and/or pump assembly 25 is possible or is not possible, or may require destruction of one or more of the bottle 22, key collar 26 or piston chamber forming member 30 can be selected as desired. For example, at the time of assembly, the bottle 22, piston chamber forming member 30 and collar 26 can be permanently secured together as with glue or by sonic welding.

In a preferred embodiment, the interior side wall 38 of the collar 26 may be knurled with axially extending alternating ribs and slotways only partially shown at 170 in FIG. 7 such that a complementarily knurled outer surface of the outer flange 31 having axially extending alternating ribs and slotways may couple with ribs on the side wall 38 preventing relative rotation of the piston chamber forming member 30 relative to the collar 26 once the collar is applied.

With the backplate assembly 14, presser member 15 and shroud 16 assembled and, for example, secured to a wall, the assembled reservoir assembly 12 may be coupled thereto by the reservoir assembly 12 moving vertically downwardly relative the backplate assembly 14 with the collar member 26 and pump assembly 25 to pass vertically downwardly through an opening 190 in the plate 18, and the entire reservoir assembly 12 then being urged rearwardly to engage a rear support portion 191 of the plate 18 above the collar 26 and below a lower shoulder 192 on the bottle placing the piston 32 into a position for coupling with or in which it is coupled with the presser member 15. Removal of the reservoir assembly 12 is accomplished by reversed movement forwardly then upwardly.

Figure 4:
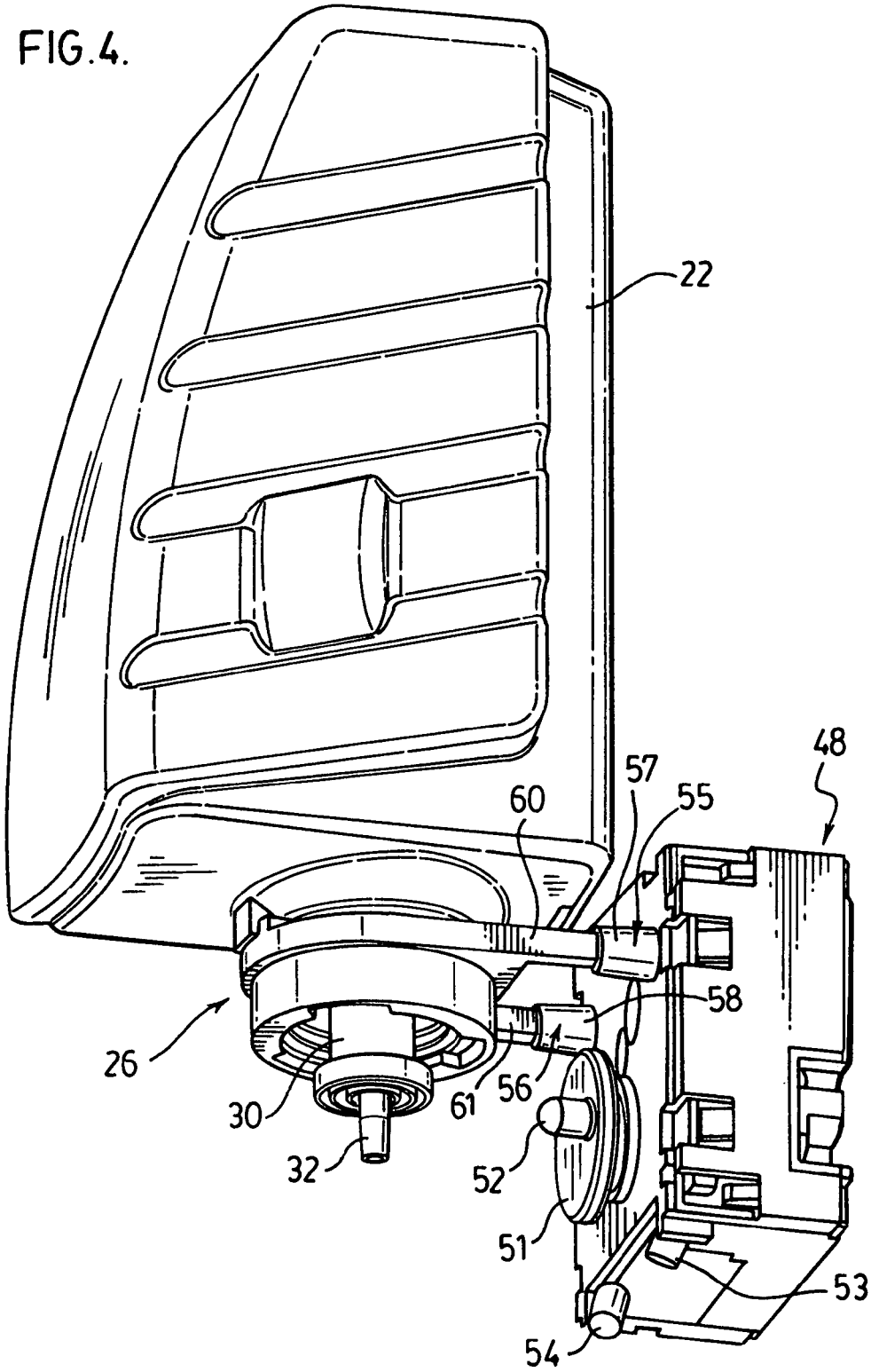
FIG. 4 is a schematic pictorial side view showing the relative positioning of the reservoir assembly and an activation unit in the assembled dispenser of FIGS. 1 and 3.
Figure 8:
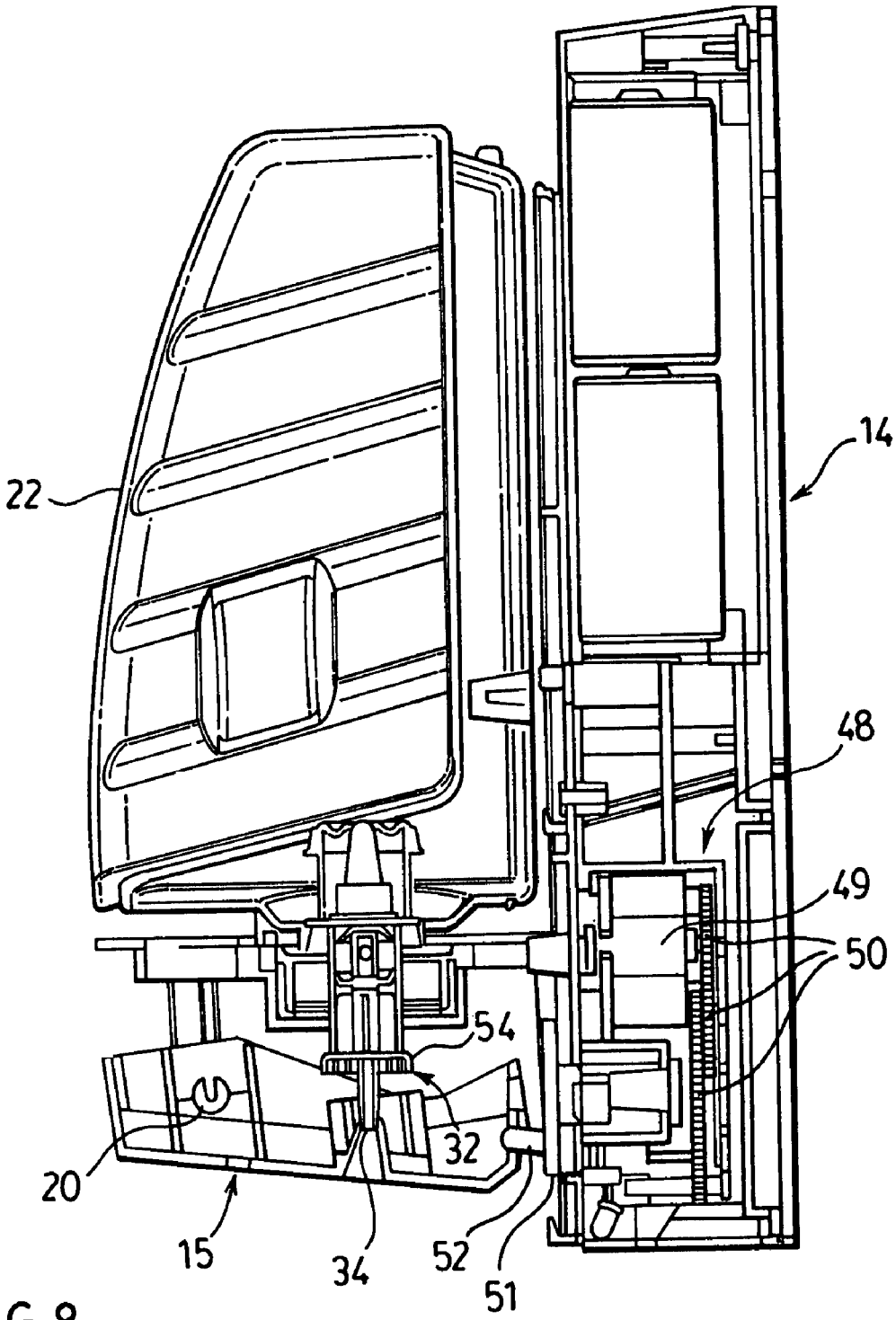
FIG. 8 is a schematic cross-sectional side view of the dispenser assembly 10 shown in FIG. 1.

The backplate assembly 14 includes and carries an activation unit 48 best seen in FIG. 4. The activation unit 48 includes as only schematically shown in FIG. 8, an electric motor 49 which rotates via a series of gears 50, a drive wheel 51 carrying an eccentrically mounted axially extending cam post 52 shown in FIG. 4. The cam post 52 couples to an inner end of the presser member 15 such that in rotation of the drive wheel 51 in one full revolution, the presser member 15 is pivoted about its stub axles 20 downwardly and then upwardly, returning to the same position. The presser member 15 is coupled to the piston 32 by engagement between catch members (not shown) carried by the presser member 15 with an engagement flange 54 on the piston 32. Such catch members and engagement may be similar to that described in U.S. Pat. No. 5,373,970 to Ophardt dated Dec. 20, 1994, the disclosure of which is incorporated herein by reference, which engagement necessarily results on coupling of the reservoir assembly 12 with the backplate assembly 14.

In one cycle of operation, the motor 49 is operated so as to rotate the drive wheel 51 360 degrees and thus move the piston 32 in a single stroke inwardly and outwardly to dispense an allotment of fluid from the bottle 22. The motor 49 is an electric motor and its operation may be controlled by a control mechanism receiving various inputs. The activation unit 48 shown is adapted to be used as a touchless dispenser in which the presence of a user's hand below the presser member 15 underneath the discharge outlet 34 is sensed by a hand sensing system including an electromagnetic radiation emitter 53 located at the bottom front of the activator unit 48 to direct radiation downwardly and forwardly towards the position the user's hand is to be placed and an electromagnetic radiation sensor 54 also located near the bottom front of the activation unit 48 adapted to sense radiation reflected off the user's hand. The hand sensing system, on suitable receipt of reflected radiation from the hand, provides a suitable signal to the control mechanism indicating the presence of the hand, for example, satisfying at least one condition for operation of the motor.

While the use of a hand sensing mechanism involving electromagnetic emitter 53 and sensor 54 is illustrated, many other systems may be provided to provide a primary indication that fluid should be dispensed. For example, these could include providing a simple on/off switch to be manually activated, or a requirement for identification as by use of a fingerprint as disclosed, for example, in U.S. Pat. No. 6,206,238 to Ophardt, issued Mar. 27, 2001.

The activation unit 48 also includes portions of an optical key system towards determining if the reservoir assembly 12 is compatible with the activation unit 48, that is, whether the reservoir assembly 12 meets pre-selected criteria to permit use with the activation unit 48. The activation unit 48 includes an electromagnetic radiation key emitter 55 and an electromagnetic radiation key sensor 56. Each is provided on the front face of the activation unit 48 on an upper portion of the activation unit and directed forwardly. As best seen in FIG. 2, the key emitter 55 includes a generally cylindrical shroud 57 about its lamp and the key sensor 56 includes a similar shroud 58 about its sensor, which shrouds 57 and 58 substantially prevent any transmission of electromagnetic radiation therethrough and effectively serve to directionalize the key emitter 55 and key sensor 56 so as to restrict emissions or receptions of either to light passing through the outer end of the shrouds 57 and 58. As best seen in FIGS. 4 and 7, the collar 26 has two arms 60 and 61 which extend rearwardly from the collar 26 toward each of the key emitter 55 and key sensor 57. The collar 26 provides an electromagnetic radiation wave guide from an end face 62 at the end of arm 60 through the collar 26 to the face 63 at the end of the arm 61 providing an outlet to the wave guide. The wave guide is schematically illustrated in dashed lines as 64 in FIG. 7 as extending in a generally U-shape within a U-shaped rim 65 of material disposed proximate the upper end 35 of the collar 26 about its outer periphery.

Referring to FIG. 4, electromagnetic radiation emitted by the key emitter 55 enters the wave guide 64 via the inlet end face 62 and is conducted via the wave guide 64 through the collar 26 with electromagnetic radiation to exit the wave guide 64 via the outlet end face 63 with the radiation exiting the wave guide via the outlet end face 63 to be sensed by the key sensor 56. The activation unit 48 includes a key control system under which as a prerequisite to dispensing, having regard to the electromagnetic radiation emitted by the key emitter 55, the electromagnetic radiation sensed by the key sensor 56 is to comply with one or more pre-selected parameters. As by way of a non-limiting example, the key emitter 55 may emit electromagnetic radiation within a selected range of wave lengths and, in the absence of the key sensor 56 sensing electromagnetic radiation within the range of emitted radiation, the motor 49 may not be permitted to operate. Thus, in the simplest case, should a non-compliant reservoir assembly 12 which has the bottle 22, pump assembly 25 but not the collar 26, be coupled to the backplate assembly 14 and would not have a wave guide, the radiation of a selected wavelength emitted by key emitter 55 would not be directed to or sensed by the key sensor 56 and the control mechanism of the activation unit would not permit dispensing.

In the preferred embodiment, the collar 26 may preferably be formed as by injection molding from a plastic material which permits transmission of electromagnetic radiation therethrough. As is known to a person skilled in the art, various plastic materials such as polycarbonate plastics can be used which provide a resultant product having electromagnetic radiation transmitting properties. Radiation which may enter the light transmitting collar 26 as by being directed normal to the inlet end face 62 will, to some extent, be reflected internally by reason of such light impinging at relatively low angles on the external surfaces of the collar forming effectively the sides of the wave guide. A portion of the radiation directed into the collar 26 is passed through the collar 26 as around the U-shaped external rim 65 with some proportion of the radiation to be directed substantially perpendicular to the exit end face 63 to exit the wave guide and be sensed by the key sensor 56.

The collar 26 may be formed as unitary element all from the same radiation transmitting properties or may be formed from a number of different materials. For example, to increase internal reflection, exterior surfaces of the collar 26 especially about the rim 65 could be coated with a reflective material other than on the inlet end face 62 and the outlet end face 63. The collar 26 may be formed such that merely a U-shaped portion of the collar, for example, substantially corresponding to the U-shaped rim 65 may comprise light transmitting materials and the remainder of the collar may be formed of other plastic materials.

The collar 26 may be formed to incorporate therein one or more pre-existing optical fibres, for example, disposed to extend internally within the U-shaped rim as with an inlet end of an optical fibre to be presented at the inlet end face 62 and an outlet end of the optical fibre to be presented at an outlet end face 63.

Figure 9:
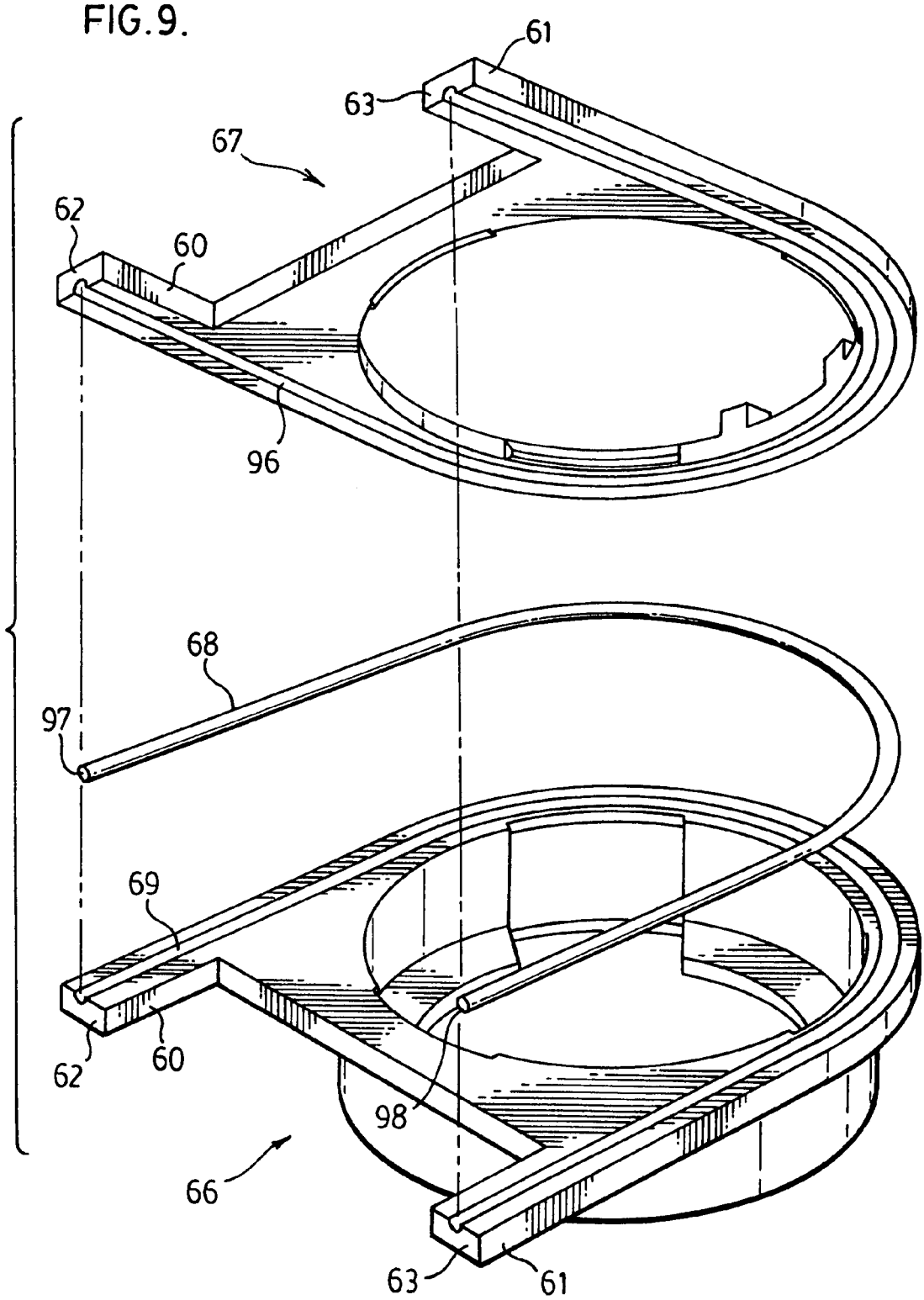
FIG. 9 is an exploded pictorial view of a second embodiment of a collar which, when assembled, would have external features identical to that shown in FIG. 7.

Reference is made to FIG. 9 which shows a second embodiment of a collar 26 in accordance with the present invention which will have, when assembled, an identical appearance to the collar 26 shown in FIG. 7. The collar 26 as shown in FIG. 9 is formed from three pieces, namely, a base 66, a top 67 and an optical fibre member 68. The base 66 and top 67 are injection moulded from plastic and are adapted to snap-fit together against separation. The base 66 has an upwardly directed U-shaped half channel 69 formed therein and the top 67 has a similar downwardly directed U-shaped half channel 96. The optical fibre 68 is positioned sandwiched between the base 66 and top 77 received between the half channel member 69 carried on the base and the half channel member 96 carried on the top. The optical fibre 68 has a first end 97 open to the end face 62 of the arm 60 and a second end 98 open to the end face 63 of the arm 61 such that the optical fibre member 68 provides the wave guide through the collar 26. In the assembled collar 26, the optical fibre member 68 is secured within the collar 26 against removal. The optical fibre member 68 may comprise a short length of a conventional optical fibre or may preferably comprise an extrusion of plastic material having appropriate light transmitting properties such as a cylindrical extrusion of flexible polycarbonate or other plastic.

The channelway which is formed by combination of the half channels 69 and 96 may preferably have adjacent each end face 62 and 63 a port portion of restricted cross-sectional closely sized to tightly hold each end of the optical fibre member 68 therein and with interior portions of the channelway interior from the port portions of increased diameter to facilitate easy insertion of interior portions of the optical fibre members 68.

Figure 10:
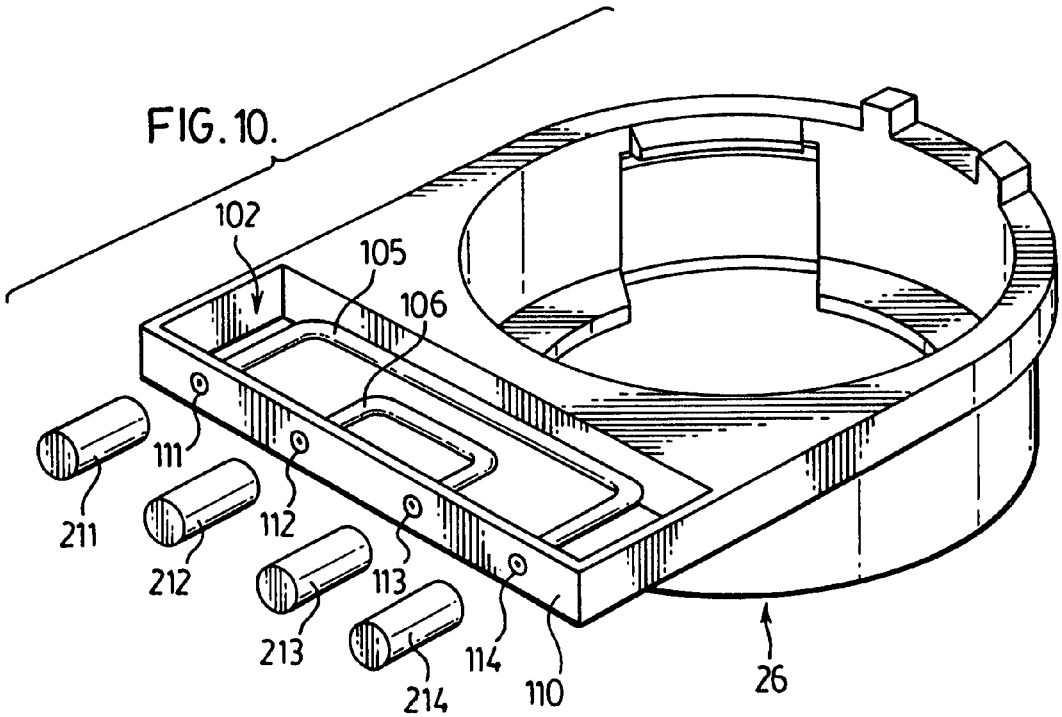
FIG. 10 is a schematic pictorial view showing a third embodiment of a collar similar to that in FIG. 7 juxtapositioned with four key emitters/sensors to be carried on the backplate assembly.

Reference is made to FIG. 10 which illustrates a third embodiment of a collar 26. As seen in FIG. 10, at the rear end of the collar 26, an internal compartment 102 is provided closed at its rear by a rear wall 110 having four port portions 111, 112, 113 and 114 therethrough. Two optical fibre members 105 and 106 are shown. Each optical fibre has a first end secured in one of the port portions and a second end secured in another of the port portions such that each optical fibre member provides a respective wave guide from one port portion to a second port portion. Opposite each of the port portions, four elements 211, 212, 213 and 214 are schematically shown, each of which is intended to schematically illustrate either a key emitter or a key sensor to be carried on an activation unit such as shown, for example, in FIG. 4 suitably located in front of a respective of the port portions. Of the four elements, preferably, at least one comprises an emitter and at least one comprises a sensor. In one preferred embodiment, each of these elements may each comprise either an emitter or a sensor or, preferably, both. Preferably, each of the elements 211, 212, 213 and 214 are carried on a computerized control circuit permitting selected operation of each of the elements either as an emitter or a sensor or to be inoperative. Such an activation unit can be electronically keyed to adopt a particular configuration of sensors and emitters.

In the embodiment illustrated in FIG. 10, two optical fibre members 105 and 106 are shown. It is to be appreciated that merely one optical fibre member need to be provided. For example, a single optical fibre member could be provided to connect any two of the port portions. For example, an optical fibre could have one end connected to the port portion 111 and a second end connected to any one of the port portions 112, 113 or 114. In a simple configuration, the element 121 could be programmed to be a key emitter and a selected one of the elements 212, 213 and 214 could be selected to be a sensor having regard to the corresponding port portion to which the end of a single optical fibre member may be connected. The collar member thus, by suitable positioning of the optical fibre member, may be configured to provide a wave guide at a matching location. If desired, a second optical fibre member could be used to couple the remaining two of the port portions which are not assumed by the first optical fibre member as seen in FIG. 10.

Each of the optical fibres which are used may have different radiation transmission characteristics. For example, one of the optical fibre members may be tinted blue such that that optical fibre serves as a filter to prevent passage therethrough of light which is not within a range of corresponding blue wavelengths. Similarly, the other optical fibre could be tinted red and yellow so as to act as filters merely permitting the passage of red or yellow wavelength light.

Figure 11:
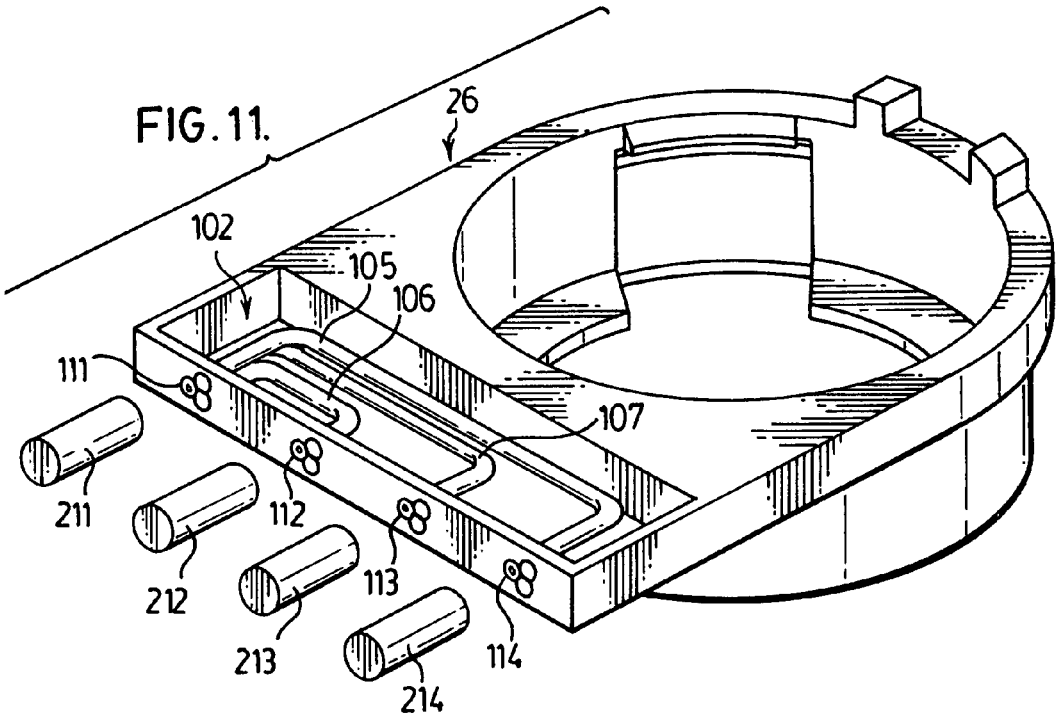
FIG. 11 is a schematic pictorial view similar to FIG. 10 but showing a fourth embodiment of a collar.

Reference is made to FIG. 11 which illustrates a fourth embodiment of a wave guide in accordance with the present invention similar to that shown in FIG. 10, however, incorporating three different optical fibres 105, 106 and 107. Additionally, each of the port portions 111, 112, 113 and 114 are each shown as having three opening therethrough, each of which opening is adapted to receive the end of one optical fibre member. Thus, up to three optical fibre members can be received in each port portion. In the particular configuration shown in FIG. 11, a first end of each of the three optical fibres is connected to the port portion 111, however, merely one end of a different one of the three optical fibres is connected to each of the ports 112, 113 and 114. In the embodiment illustrated in FIG. 11 as one preferred non-limiting example, the optical fibre 105 preferably is tinted blue so as to act as a filter and prevent the passage of light other than of corresponding blue wavelength light therethrough. The optical fibre 106 is tinted red and acts as a filter to prevent the passage of light other than corresponding red wavelength light therethrough. The optical fibre 107 is tinted yellow and acts as a filter to prevent the passage of light other than corresponding yellow wavelength light therethrough. The element 211 may be adapted to selectively emit light containing all of blue, red and yellow light or merely one or more of blue, red or yellow light at different times and each of the sensors 212, 213 and 217 will look at an appropriate time for light, the absence of light of any wavelength or, alternatively, light at a selected blue, red and/or yellow wavelength.

Figure 12:
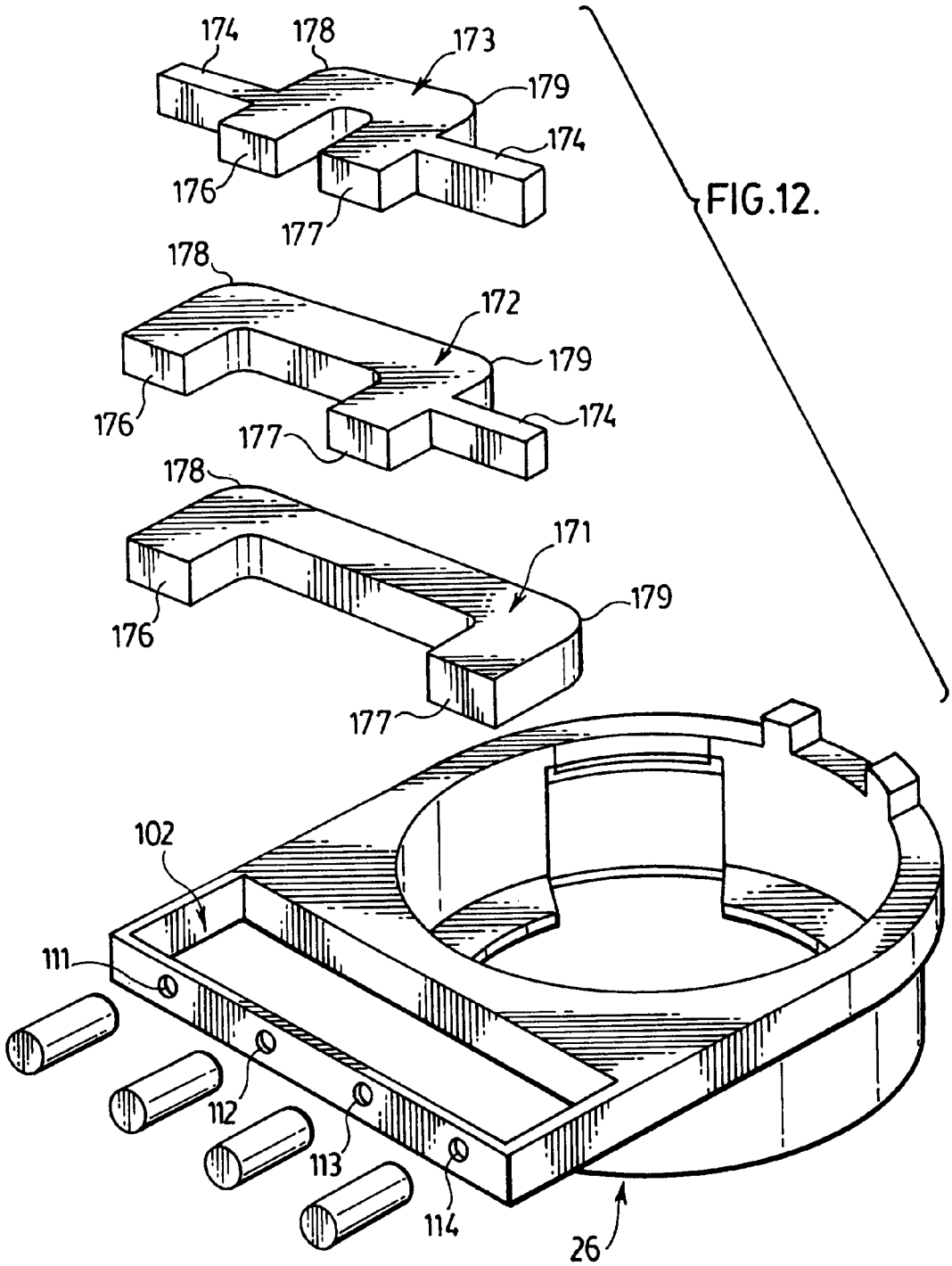
FIG. 12 is a schematic exploded pictorial view similar to FIG. 10 but showing a fifth embodiment of a collar with three alternate wave guide inserts for use therewith.

Reference is made to FIG. 12 which illustrates a fifth embodiment of a collar member 26 having similarities to that illustrated in FIG. 10, however, in which the optical fibre members have been removed and are to be replaced by one of the three wave guide inserts shown as 171, 172 and 173 in schematic exploded perspective in FIG. 15. Each of the wave guide inserts are preferably injection moulded from a light transmitting material such as polycarbonate. Insert 171 is adapted to provide light transmission from the portal portion 111 to the portal portion 114. An insert 172 is adapted to be inserted as shown to provide communication between portal 111 and portal 113 or if inverted 180 degrees to provide communication between portal 112 and portal 114. Insert 173 is adapted to provide communication between portals 112 and 113. By the suitable selection of a relatively simple injection moulded plastic insert 171, 172 or 173, the collar member 26 may be configured to have a desired wave guide therein. Each of the inserts may be provided to have different radiation transmission properties and may, for example, act as a colour filter. Each insert 171, 172 and 173 is sized to closely fit inside the compartment 102 with side locating tabs 174 provided to extend the side-to-side dimension of inserts 172 and 173. Each insert has two faces 176 and 177 to serve as an inlet/outlet to its wave guide relative its respective portals. Curved portions 178 and 179 of the wall of the insets opposite the faces 176 and 177 assist in directing radiation internally from one face to the other.

Figure 13:
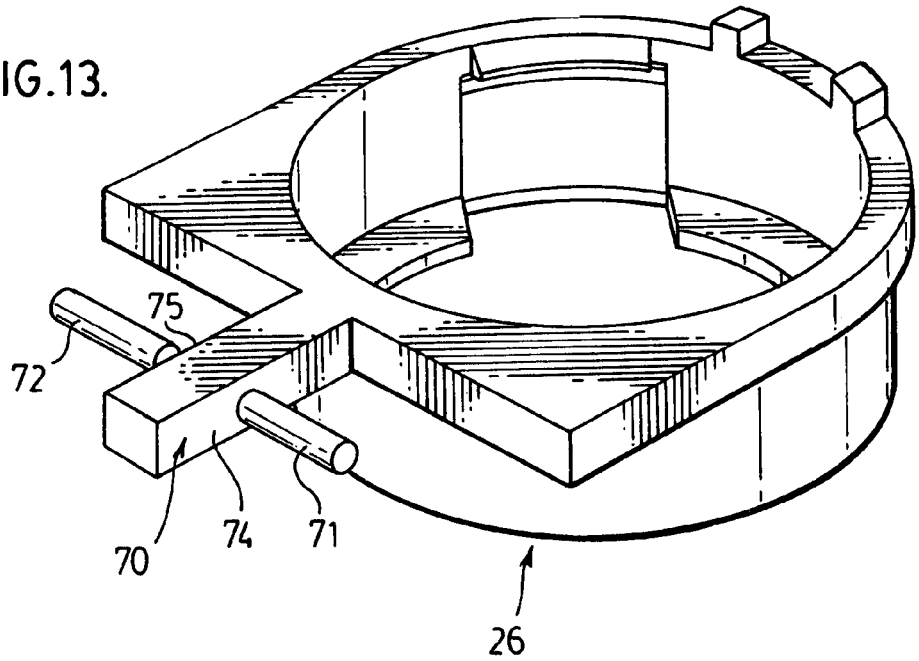
FIG. 13 is a schematic pictorial view of a sixth embodiment of a collar also schematically showing a key emitter and key sensor to be carried on a backplate assembly.

Reference is made to FIG. 13 which schematically illustrates a sixth embodiment of the collar and key sensing system in accordance with the present invention. As seen in FIG. 13, the collar 26 is identical to the collar in the first embodiment of FIG. 7 with the exception that the arms 60 and 61 are removed and a key member 70 is provided to extend rearwardly. The actuation unit 48 is modified such that a key emitter 71 is located to one side of the key member 70 directing radiation sideways through the key member 70 and a key sensor 72 is on the other side of the key member 70 directed sideways. In this manner, the key emitter 71 directs radiation into an inlet face 74 on one side of the key member 70 and the key sensor 72 senses radiation passing outwardly through an outlet face 75 on the other side of the key member 70. The key member 70 preferably provides a wave guide for transmission of electromagnetic radiation. As one non-limiting example, the wave guide may include a wave guide which acts like a filter which substantially prevents any transmission of radiation therethrough of light of a first certain characteristic or wavelength yet lets light of a second characteristic or wavelength pass through, and the key sensor 72 at the time light of both the first and second certain characteristic or wavelengths is emitted by the key emitter 71 looks for the absence of light of the first characteristic or wavelength and the presence of light of the second characteristic or wavelength.

With the key member 70 located in a vertical slotway between the key emitter 71 and the key sensor 72, their engagement can prevent relative rotation of the reservoir assembly 12 relative the backplate assembly 14.

While the embodiment illustrated in FIG. 13 shows a collar merely with the key members, it is to be appreciated that a modified collar could be provided in having both the arms 64 and 65 providing a first wave guide and the key block providing a second guide and that two separate key emitters may be provided and two separate key sensors may be provided.

Figure 14:
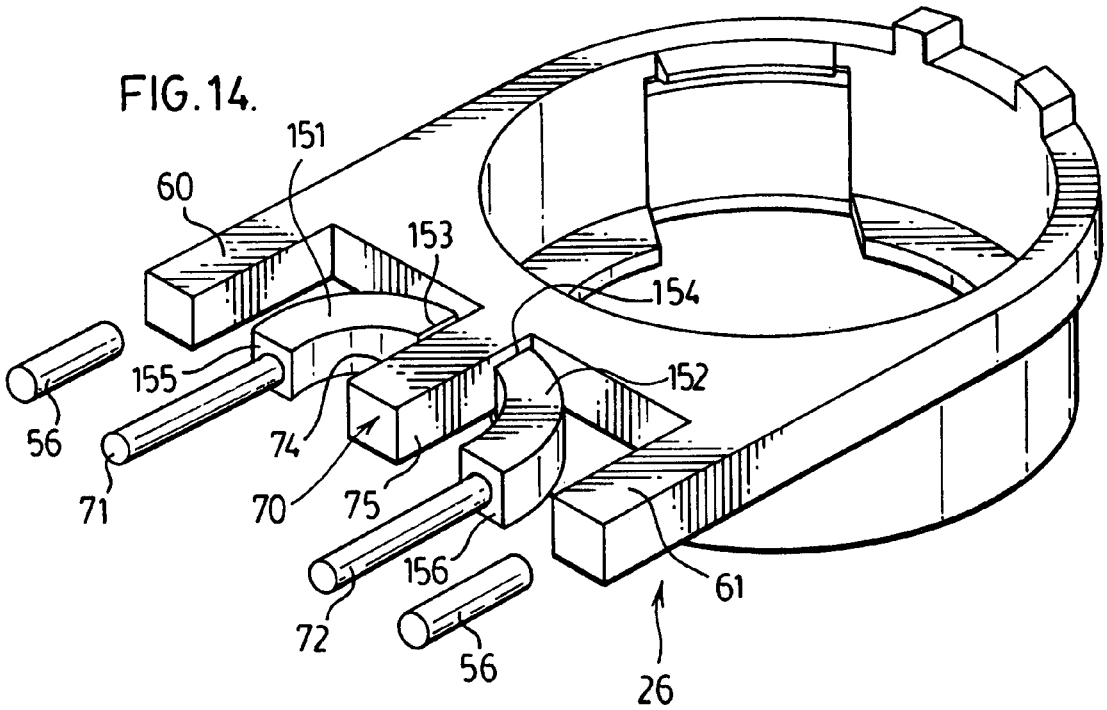
FIG. 14 is a schematic pictorial view of a seventh embodiment of a collar also schematically illustrating four key emitters/key sensors to be carried on the backplate assembly.

Reference is made to FIG. 14 which illustrates a seventh embodiment of a key member in accordance with the present invention which has features similar to those shown in FIG. 7 and in FIG. 13. In FIG. 14, a central key member 70 is provided serving as a wave guide for passage of radiation laterally therethrough. On either side of the key member 70, there are provided a pair of wave guide extensions 151 and 152 adapted to be securely carried on the backplate assembly. Each wave guide extension includes an outer face 153 or 154 directed laterally towards a respective face 74 or 75 of the key member 70 and an inner end 155 or 156 directed rearwardly and adapted for optical coupling with a key emitter/sensor element 71 or 72 also carried on the backplate assembly. As in the embodiment of FIG. 7, the collar 26 includes at the end of each arm 60 and 61, end faces 62 and 63 served to be optically coupled with two key emitters/sensors 56 and 57 carried on the activation unit.

In the embodiment illustrated in FIG. 13, a portion of the wave guide is provided as the wave guide extensions 151 and 152 on the activation unit and a portion of the wave guide is provided as the key member 40 on the collar member 26.

Reference is made to FIG. 15 which illustrates a selective optical coupling mechanism illustrating a pair of key emitter or sensor elements 56 and 57 disposed opposite to optical first windows 163, 164 carried in a coupling unit 165. The coupling unit 165 is a generally rectangular shaped member with a pair of cavities 166, 167 having a narrow end 168 open to the first windows 163, 164 and a wide end 169 open to second windows 181, 182, 183 with two for each of the cavities. A wave guide member 184 having a generally parallelogram shape is adapted to be received within either cavity 166 or 167 in a position which connects a first window to one of the second windows. The wave guide member 184 can be rotated 180 degrees and placed in a cavity so as to provide a wave guide between a first window at the first end and a different other of the second window at the second end. Such an arrangement can be provided either in a cavity in the collar member 26 or in a portion of a cavity on the activation unit and thus can form another method for mechanically selecting a relative path of a portion of the wave guide either carried by the collar 26 or the activation member 48.

It is to be appreciated that different wave guide members 184 may have different properties such as different abilities to transmit, filter, block or polarize electromagnetic radiation passed therethrough. For example, a plurality of such members could be provided of different tinted colours, blue, red, yellow, green and the like and provide simple members which can be readily manually inserted to a customized activation member or a collar member for a particular desired configuration.

In accordance with the present invention, the electromagnetic radiation may be selected having regard to pre-selected parameters. These parameters may include radiation within one or more ranges of wavelengths, electromagnetic radiation within one or more ranges of intensity, polarized electromagnetic radiation, and electromagnetic radiation within one or more ranges of duration and at one or more different points in time.

The wave guide which is provided may have electromagnetic radiation transmitted properties selected from a plurality of properties and including the ability to transmit one or more ranges of wavelengths and or the ability to block one or more ranges of wavelengths, the ability to restrict the intensity of electromagnetic radiation which can be transmitted through the wave guide, preferably, as a function of most of the wave guide. The transmission properties may restrict the transmission of radiation having a first range of wavelengths yet permit transmission of radiation having a range of second wavelengths.

Reference is made to FIGS. 16 and 17 which illustrate cross-sections through the collar 26 shown in FIG. 7 along section lines A and B, respectively, in axially extending planes which extend radially from a center through the central opening 37. In each of FIGS. 16 and 17, the radially extending rim 65 is shown as rectangular in cross-section containing and effectively forming throughout the inner rectangular cross-sectional area of the rim 65 the wave guide 64.

FIG. 18 illustrates a schematic cross-sectional similar to that shown in FIGS. 16 and 17, however, at a cross-sectional point in between section lines A and B at a point in between a circumferential end of the shoulder member 40 and before the stop shoulder 80 is provided. The cross-sectional area shown in FIG. 18 superimposes a dashed line showing the outline of the cross-section of FIG. 17. The cross-section in FIG. 18 is of a considerably reduced cross-sectional area compared to that shown in either FIGS. 16 or 17. That circumferential portion of the collar 26 represented by the cross-section of FIG. 18 comprises, in effect, a frangible portion. Insofar as a person may attempt to remove the collar 26 from engagement on the reservoir assembly, circumferentially applied forces on being transmitted to the reduced cross-sectional segment shown in FIG. 18 will result in breaking and rupture of the collar through this reduced cross-sectional area, thus, breaking and rupturing the wave guide 64. In FIG. 18, the cross-sectional area of the wave guide 64 is shown to be a reduced sized triangular portion compared to the rectangular area shown in FIGS. 16 and 17. The cross-sectional area of the wave guide through the frangible portion is selected to be adequate to permit radiation to pass through the wave guide in normal use. When the collar member 26 may be broken by circumferential severing through the reduced cross-sectional area portion of FIG. 18, the wave guide 64 will be broken with the broken wave guide preferably preventing or impairing the ability of the wave guide to transfer radiation through the break point. In the embodiment illustrated in FIG. 18, it is expected that initial fracture may occur in the lower portion below the triangular wave guide which may assist in splitting through the wave guide from the lower apex of the triangular wave guide upwardly to a wider portion at the top.

Many modifications and variations of frangible wave guides or wave guides which will break if a collar is attempted to be physically removed can be envisioned. For example, in the context of a wave guide which incorporates a pre-existing optical fibre member such as shown in FIG. 9, a mechanism can be structured to sever the optical fibre member as a requirement of removal of the collar.

Reference is made to FIG. 19 which illustrates a schematic pictorial view of a portion of a wave guide 200 formed from three modular wave guide elements 201, 202 and 203. The wave guide element 201 has a first end face 210 and a second end face 211. The member 201 is a constant cross-sectional shape between the end faces. As schematically illustrated by the parallel lines 212, the guide wave member 201 is polarized so as to restrict light passing between the end faces 210 and 211 to being light which propagates parallel to each other in a certain direction. Wave guide member 212 is identical to wave guide member 210, however, is shown in the embodiment as rotated 90 degrees such that it has the schematic parallel lines 212 of wave guide member 202 is perpendicular to the parallel lines 212 on the wave guide member 201. When arranged in this configuration as shown in FIGS. 19 and 20, the wave guide members 201 and 202 effectively block all light transmission therethrough. Wave guide member 203 is shown as a similarly sized wave guide member which may be selected, for example, to be of a particular colour such as the colour blue. The wave guide members 201, 202 and 203 are each modular members which can be replaced or substituted by other members and thus by simple insertion or removal of different modular members provide for different light transmission characteristics of the resultant wave guide. While the wave guide member 203 is shown as being of a particular colour, it is to be appreciated that each of the wave guides 201 and 202 could be provided as modular elements in a plurality of different colours.

Each of the wave guide members 201, 202 and 203 may be stacked immediately adjacent to each other and, for example, to form a central portion of the replaceable wave guide 184 is shown in FIG. 15. It is to be appreciated that in a manner similar to that shown in FIG. 15, a coupling unit similar to 165 could be provided as with a rectangular recess so as to receive each of the three wave guide members 201, 202 and 203 aligned in a row.

One or more of the wave guide members 201, 202 and 203 may be provided as part of a wave guide on the activation unit and any one or more of the wave guide members 201, 202 or 203 or other similar modular wave guide members may be provided on the collar 26. Further, insofar as the wave guide may have different abilities to polarize light passing therethrough, such a wave guide may be used with either an emitter of polarized light or a sensor sensitive to polarized light.

The use of a plurality of different modular guide members such as 201, 202 and 203 to form the wave guide can provide a simplistic mechanism for customizing the wave guide to have selected key features.

In the preferred embodiments illustrated, for example, in FIG. 4, in combination with a suitable wave guide, there is shown both a key emitter 55 and a key sensor 56. It is not necessary in accordance with the present invention that a key emitter 55 be provided. The electromagnetic radiation to pass through the wave guide and be sensed by the key sensor may originate from an external light source such as, for example, the ambient light in any environment, for example, ambient light from lighting within a washroom or natural sunlight. For example, as seen in FIG. 1, the front portion of the shroud 16 indicated as 220 in FIG. 1 could be provided to transmit electromagnetic radiation therethrough which may impinge on a frontmost surface 221 of the collar 26 as shown in FIG. 2 which could be flattened and directed forwardly so as to provide an entry point for light into the wave guide contained in the collar. In this case, merely the radiation sensor 56 need be provided.

Alternatively, entrance for ambient air to the wave guide could be provided at the sides or bottom of the wave guide through a suitable face in the wave guide disposed to permit entry into the wave guide of electromagnetic radiation from an external source. As another example, in the context of FIG. 2, the bottle and fluid within the bottle 22 may be provided to be electromagnetic radiation transmitting with light to pass downwardly through the bottle 22 through the lower shoulder 192 and down onto an upwardly directed surface of the collar 26. The wave guide may then comprise the walls and shoulder of the bottle 22, the fluid in the bottle as well as the collar 26.

Suitable selection of the radiation transmission properties therefore of the bottle walls and bottom and the fluid to be dispensed can be utilized in establishing pre-selected keying features.

Insofar as light may pass downwardly through the shoulder 192 in the bottle 22 to the collar 26, it would be possible to incorporate a component of the pump assembly such as a radially outwardly extending flange of the piston chamber forming member 30 as being part of the wave guide and in such an event, the wave guide might incorporate a path downwardly through the shoulder 192 of the bottle past or through the support plate 18 and axially through the outer flange 31 of the piston chamber forming member 30 as to a portion of the wave guide as to a sensor disposed axially below the outer flange 31. Preferably, the wave guide would be at least partially through the collar 26 at some portion such as axially through the collar or radially outwardly through a portion of the collar 26 which would serve as a wave guide to couple light from the outer flange 31 to a sensor carried on the activation unit 12.

Rather than use ambient light to pass through portions of the bottle and/or fluid in the bottle, a separate emitter could be provided as, for example, to pass radiation downwardly or sideways or otherwise which would pass through a portion of the bottle and/or the fluid in the bottle to be received by a sensor.

As to the nature of electromagnetic radiation to be used, many conventionally available sensors and/or emitters are available for use in emitting and sensing electromagnetic radiation in the visible light spectrum. This is not necessary, however, and electromagnetic radiation outside the visible spectrum may be used. This could be advantageous as, for example, to mask the nature of any modular components which may comprise a portion of a wave guide. For example, whether or not any modular wave guide element may appear to have a visible colour such as blue, red or yellow, insofar as it is adapted for transmission of non-visible electromagnetic radiation, then the presence or absence of colour in the modular unit could assist in fooling an imitator.

While the invention has been described with reference to preferred embodiments, many modifications and variations will now occur to persons skilled in the art. For a definition of the invention, reference is made to the following claims.

We claim:

1. A method of controlling operation of a dispensing mechanism having a removable component removably coupled thereto comprising the steps of:

measuring electromagnetic radiation passing through a wave guide carried on a removable, replaceable component, and permitting operation of the dispensing mechanism only when measured electromagnetic radiation complies with one or more pre-selected output parameters, emitted electromagnetic radiation entering the wave guide complies with one or more pre-selected input parameters, the pre-selected input parameters are selected from a plurality of input parameters, an electromagnetic radiation transmission property of the wave guide is selected from a plurality of electromagnetic radiation transmission properties, and the pre-selected output parameters are a function of the pre-selected input parameters and the electromagnetic radiation transmission property of the wave guide.

2. A method as claimed in claim 1 wherein the wave guide has an entrance and an outlet, and further including the steps of:

directing the emitted electromagnetic radiation into the entrance to the wave guide, and measuring the electromagnetic radiation passing through the wave guide by sensing the electromagnetic radiation exiting from the outlet of the wave guide.

3. A method as claimed in claim 2 further including the steps of:

emitting the emitted electromagnetic radiation from an electromagnetic radiation emitter, and directing the emitted electromagnetic radiation into the entrance to the wave guide.

4. A method as claimed in claim 1 wherein the wave guide has the pre-selected radiation transmission property.

5. A method as claimed in claim 1 wherein the pre-selected input parameters require electromagnetic radiation within a first input range of wavelengths, the pre-selected output parameters require electromagnetic radiation within a first output range of wavelengths within the first input range of wavelengths, and the electromagnetic radiation transmission property of the wave guide restricts transmission of the electromagnetic radiation having a wavelength within the first input range of wavelengths but outside of the first output range of wavelengths.

6. A method as claimed in claim 5 wherein the pre-selected input parameters require electromagnetic radiation within a first input range of intensity, the pre-selected output parameters require electromagnetic radiation within a first output range of intensity within the first input range of intensity, and the electromagnetic radiation transmission property of the wave guide reduces the intensity of transmission therethrough to pre-selected proportions of at least some wavelengths of the electromagnetic radiation within pre-selected ranges.

7. A method as claimed in claim 1 the pre-selected input parameters require a first emission of electromagnetic radiation within a first input range of wavelengths and a second emission of electromagnetic radiation within a second input range of wavelengths;

the pre-selected output parameters require a first reception of electromagnetic radiation within a first output range of wavelengths within the first input range of wavelengths and a second reception of electromagnetic radiation within a second output range of wavelengths within the second input range of wavelengths, and the electromagnetic radiation transmission property of the wave guide restricts transmission of electromagnetic radiation having a wavelength within the first input range of wavelengths but outside of the first output range of wavelengths, and the electromagnetic radiation transmission property of the wave guide restricts transmission of the electromagnetic radiation having a wavelength within the second input range of wavelengths but outside of the second output range of wavelengths.

8. A method of controlling operation of a dispensing mechanism having a removable component removably coupled thereto comprising the steps of:

measuring electromagnetic radiation passing through a wave guide carried on a removable, replaceable component, and permitting operation of the dispensing mechanism only when measured electromagnetic radiation complies with one or more pre-selected output parameters, emitting a plurality of emissions of electromagnetic radiation at different times and simultaneously with each respective emission sensing for corresponding electromagnetic radiation exiting from an outlet of the wave guide.

9. A method as claimed in claim 8 wherein the emissions include emissions having different properties selected from the group of wavelength, intensity, and duration.

10. A method of controlling operation of a dispensing mechanism having a removable component removably coupled thereto comprising the steps of:

measuring electromagnetic radiation passing through a wave guide carried on a removable, replaceable component, and permitting operation of the dispensing mechanism only when measured electromagnetic radiation complies with one or more pre-selected output parameters, wherein the removable component comprises a reservoir containing material to be dispensed, the reservoir having an outlet opening for dispensing of the material therefrom, an outlet member secured to the outlet opening substantially against removal from the reservoir, the outlet member when secured to the reservoir rendering the reservoir difficult to refill with the material through the outlet opening.

11. A method as claimed in claim 10 wherein the reservoir aside from the outlet opening not having another opening via which the material can be passed except with difficulty to refill the reservoir with the material.

12. A method as claimed in claim 11 wherein including the step of on removal of the outlet member severing the wave guide.

13. A method of controlling operation of a dispensing mechanism having a removable component removably coupled thereto comprising the steps of:

measuring electromagnetic radiation passing through at least one wave guide carried on a removable, replaceable component, and permitting operation of the dispensing mechanism only when measured electromagnetic radiation complies with one or more pre-selected output parameters, each wave guide has an entrance and an outlet, and further including the steps of:

directing electromagnetic radiation into the entrance to the at least one wave guide, measuring the electromagnetic radiation passing through the at least one wave guide by sensing electromagnetic radiation exiting from the outlet of the wave guide, emitting electromagnetic radiation from an electromagnetic radiation emitter, and directing the emitted electromagnetic radiation into the entrance to the at least one wave guide, wherein the removable component has a plurality of waveguides, each with an entrance and an outlet, the method including selectively emitting different emissions of electromagnetic radiation to the entranceway of the plurality of wave guides, and measuring the electromagnetic radiation passing through said each wave guide by sensing electromagnetic radiation exiting from the outlet of each respective of the plurality of wave guides.

14. A dispensing system comprising:

a reservoir assembly including a reservoir containing material to be dispensed and an activation unit, the reservoir assembly removably coupled to the activation unit for replacement by a similar reservoir assembly, an electromagnetic radiation wave guide having an inlet and an outlet and providing a path for transmission of electromagnetic radiation from the inlet to the outlet, an electromagnetic radiation sensor carried by the activation unit sensing electromagnetic radiation from the wave guide via the outlet, at least part of the wave guide carried by the reservoir assembly and removable therewith, a control mechanism to permit operation of the dispensing system only when the electromagnetic radiation sensed by the sensor appropriately correlates to a pre-selected electromagnetic radiation profile, the reservoir having an outlet opening for dispensing of the material therefrom, an outlet member secured to the outlet opening substantially against removal from the reservoir, removal of the outlet member causing destruction of a portion of the wave guide which changes a transmission characteristic of the electromagnetic radiation from the inlet to the outlet via the path.

15. A dispensing system as claimed in claim 14 further comprising:

an electromagnetic radiation emitter carried by the activation unit directing electromagnetic radiation into the wave guide via the inlet, wherein the pre-selected electromagnetic radiation profile correlates to the electromagnetic radiation emitted by the emitter.

16. A dispensing system as claimed in claim 14 wherein the reservoir having an outlet opening for dispensing of the material therefrom, an outlet member secured to the outlet opening substantially against removal from the reservoir, the outlet member when secured to the reservoir rendering the reservoir difficult to refill with the material through the outlet opening.

17. A dispensing system as claimed in claim 16 wherein the outlet member includes a pump mechanism activatable by the activation unit to dispense the material from the reservoir out of the outlet opening;

wherein the outlet member includes a collar member coupling to the reservoir about the outlet opening and securing the pump mechanism to the reservoir against removal without removal of the collar member, the collar member secured to the outlet opening substantially against removal from the reservoir.

18. A dispensing system as claimed in claim 15 wherein the dispensing assembly is adapted to dispense the material when activated by a user at a front of the dispenser, the activation unit is at a rear of the dispensing assembly carrying the emitter and the sensor on forward portions of the activation unit, the reservoir coupled to the activation unit with portions of the reservoir assembly including the wave guide forward of the activation unit.

19. A dispensing system comprising:

a reservoir assembly including a reservoir containing material to be dispensed and an activation unit, the reservoir assembly removably coupled to the activation unit for replacement by a similar reservoir assembly, an electromagnetic radiation wave guide having an inlet and an outlet and providing a path for transmission of electromagnetic radiation from the inlet to the outlet, an electromagnetic radiation sensor carried by the activation unit sensing electromagnetic radiation from the wave guide via the outlet, at least part of the wave guide carried by the reservoir assembly and removable therewith, a control mechanism to permit operation of the dispensing system only when the electromagnetic radiation sensed by the sensor appropriately correlates to a pre-selected electromagnetic radiation profile, wherein the waveguide includes a frangible portion comprising a portion of the path, removal of the reservoir assembly from the activation unit breaking the frangible portion;

wherein when the reservoir assembly is coupled to the activation unit with the frangible portion broken, then the electromagnetic radiation sensed by the sensor will not appropriately correlate to the pre-selected electromagnetic radiation profile.

* * * * *